US005649557A

United States Patent [19]

Usher

[11] Patent Number: 5,649,557

[45] Date of Patent: Jul. 22, 1997

[54] PARTS WASHING APPARATUS

[75] Inventor: Michael D. Usher, West Bloomfield, Mich.

[73] Assignee: Usher Oil Company, Detroit, Mich.

[21] Appl. No.: 643,447

[22] Filed: May 8, 1996

Related U.S. Application Data

[63] Continuation-in-part of Ser. No. 348,716, Dec. 2, 1994, Pat. No. 5,513,667.

[51] Int. Cl.[6] ..... B08B 3/02

[52] U.S. Cl. ..... 134/107; 134/108; 134/111; 134/174; 134/186; 134/191

[58] Field of Search ..... 134/104.2, 104.4, 134/111, 174, 186, 191, 198, 199, 200, 107, 108

[56] References Cited

U.S. PATENT DOCUMENTS

| | | | |
|---|---|---|---|
| 1,714,324 | 5/1929 | Smith | 134/174 |
| 3,041,212 | 6/1962 | Booth | 134/107 X |
| 3,393,689 | 7/1968 | Faler | 134/104.4 |
| 3,522,814 | 8/1970 | Olson | 134/111 |
| 4,462,415 | 7/1984 | Otzen | 134/111 |
| 5,265,633 | 11/1993 | Knowlton | 134/135 |
| 5,303,725 | 4/1994 | Hilgren | 134/107 X |
| 5,322,078 | 6/1994 | Tuttle | 134/104.4 |

*Primary Examiner*—Philip R. Coe
*Attorney, Agent, or Firm*—Brooks & Kushman P.C.

[57] ABSTRACT

A parts washer unit including a cleaning fluid storage receptacle which can be easily interchanged or exchanged with a like receptacle by the user of the unit. The unit includes a sink tiltably mounted to the top of a support frame that defines a space accommodating the receptacle. The sink includes a bottom wall having an integrally formed cylindrical portion extending centrally from said bottom wall and defining a drain opening and a splash guard. A conveyor is secured to the frame and permits the receptacle to be readily transported to and from the desired location beneath the sink drain opening. A fluid circulating system includes a pump, a bag strainer, and hoses which extend in use into the sink for directing fluid over parts to be washed. A cover is removably secured to the receptacle and has a central opening for receiving the splash guard. When a new supply of cleaning fluid is required, the receptacle containing the contaminated fluid is easily removed from the space defined by the sink support frame and replaced by a new receptacle containing fresh fluid.

10 Claims, 3 Drawing Sheets

PARTS WASHING APPARATUS

CROSS REFERENCE TO RELATED APPLICATIONS

This is a continuation-in-part of U.S. Ser. No. 08/348,716, filed Dec. 2, 1994 and now U.S. Pat. No. 5,513,667.

TECHNICAL FIELD

This invention relates to parts washing apparatus and more particularly to a parts washer that is readily serviceable by the end user.

BACKGROUND ART

Parts washers or cleaners have been used by mechanics at auto dealerships, garages and other places of business for many years. U.S. Pat. No. 3,522,814 discloses a typical prior art parts washer comprising a sink mounted to a fluid storage receptacle that provides support for the sink and contains the fluid used to clean the parts. In order to service the parts washer the sink must be removed from the old receptacle and mounted to a new receptacle. Since the sink may contain heavy parts, they must first be removed, otherwise servicing is difficult and handling may be hazardous. Moreover, the configuration shown in the patent tends to be relatively unstable particularly when heavy parts are placed in the sink. Bowmer GB 2,203,813 recognizes the stability problem associated with the prior art as represented by U.S. Pat. No. 3,522,814 and proposes a parts washer with a tray mounted on support means above a space for a free-standing washing fluid container. However, Bowmer does not address the problems that arise during servicing the washer.

SUMMARY OF THE INVENTION

In view of the above, it is a primary object of the present invention to provide a parts washer that is readily serviceable and offers increased stability.

In accordance with the present invention a parts washer is proposed that includes a sink that is mounted to an independent support structure that is adapted to receive and support the fluid storage receptacle. The sink support structure includes a roller conveyor that supports the receptacle and permits an old receptacle to be easily replaced with a new receptacle without removing the sink during servicing of the washer. A fluid circulating system includes a submersible electric pump located in the fluid receptacle for circulating cleaning fluid between the receptacle and the sink. The cleaning fluid is preferably an aqueous solution and a heating unit is provided to elevate the temperature of the solution to improve its cleaning capabilities.

DETAILED DESCRIPTION OF PREFERRED EMBODIMENT

Figure 2:
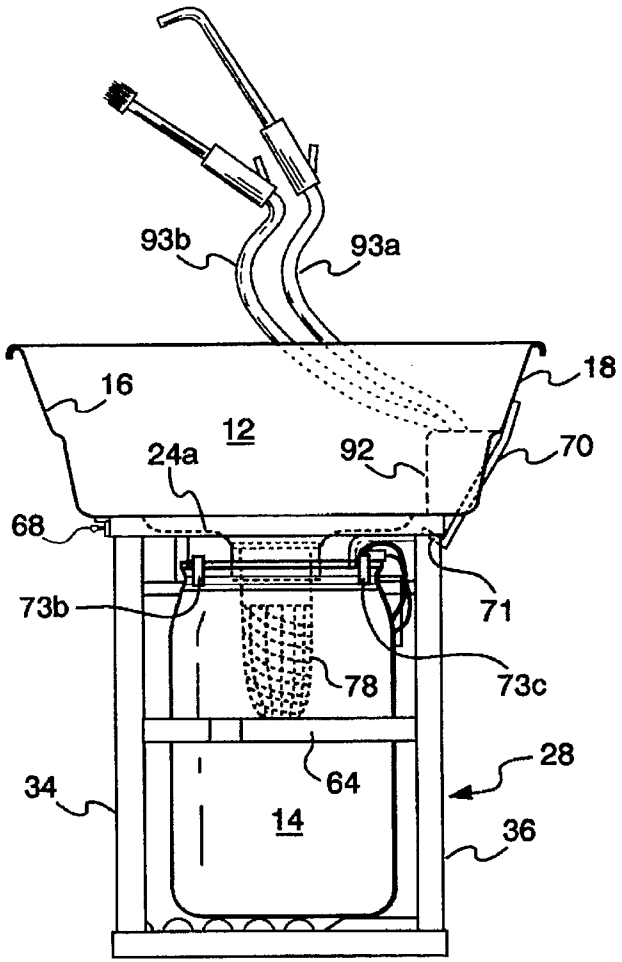
FIG. 2 is side elevation view of the parts washer of the present invention.
Figure 1:
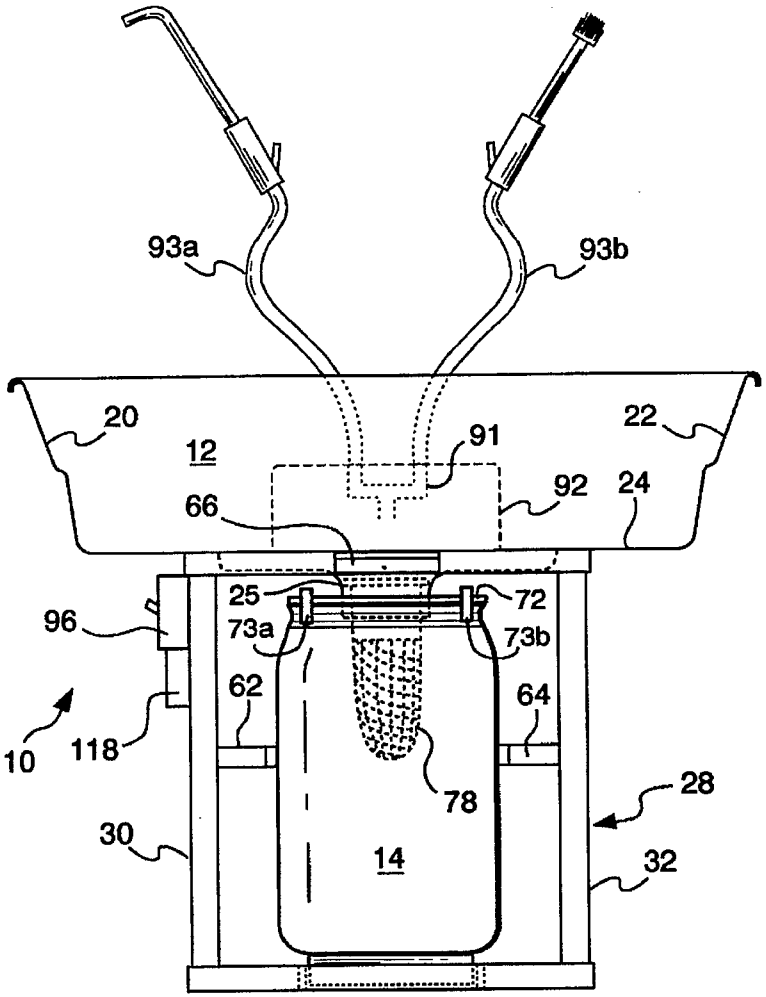
FIG. 1 is front elevation view of the parts washer of the present invention.

Referring now to the drawings, and initially to FIGS. 1–4, the parts washing apparatus of the present invention is generally designated 10 and includes a sink 12 for holding parts to be cleaned. The solution for cleaning the parts is stored in a generally barrel shaped polyethylene receptacle 14. The cleaning solution is preferably a water based alkaline detergent or similar biodegradable washing solution. The sink 12 includes front and rear walls 16 and 18, side walls 20 and 22 and a bottom wall 24 forming an enclosure for receiving and holding the parts to be cleaned. The sink 12 has a generally rectangular shaped sump area, generally designated **24*a* integrally formed in the bottom wall 24. The sump 24*a* has a centrally located, integral, cylindrical, portion 25 forming a sink drain and splash guard with a drain opening 26**.

Figure 3:
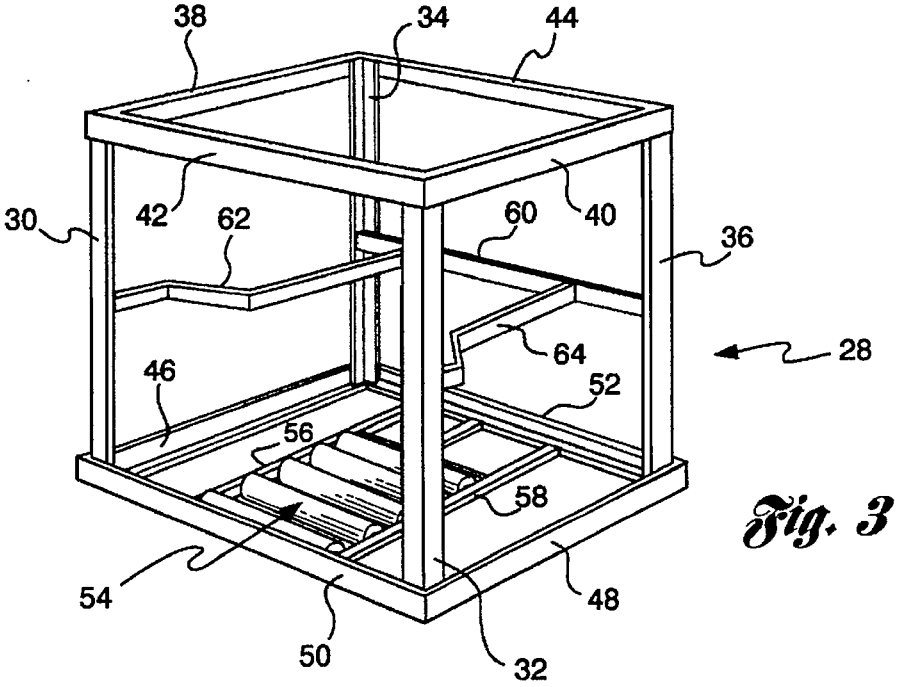
FIG. 3 is a perspective view of the parts washer of the present invention with the sink removed to show the frame for supporting the sink and fluid receptacle.
Figure 4:
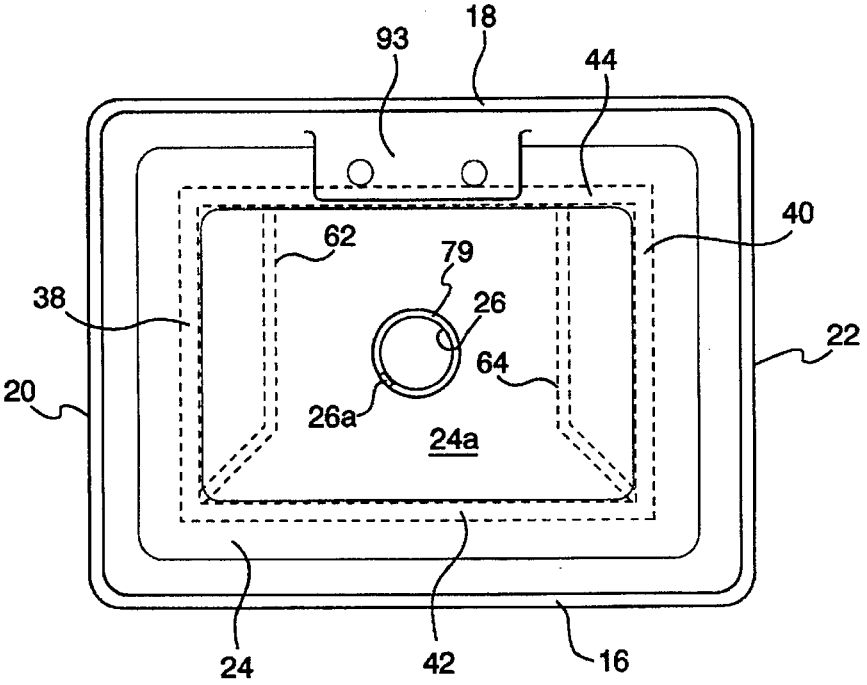
FIG. 4 is a top view of the parts washer of the present invention.

The sink 12 is supported on a metal stand or support frame generally designated 28 that is intended to rest on a work surface, not shown. The frame includes four legs 30–36 formed by steel angle members. As best shown in FIG. 3, the legs 30–36 of the stand 28 are welded to an upper generally rectangular structure comprising left and right and front and rear steel angle members 38–44, as well as to a lower generally rectangular structure comprising left and right and front and rear steel angle members 46–52. The sump **24*a* of the sink conforms to and fits within the upper rectangular structure of the stand 28**.

A light duty gravity roller conveyor generally designated 54 includes a plurality of rollers rotatably supported by channel brackets 56 and 58 that are welded to the lower front and rear angle members 50 and 52. The conveyor 54 supports the receptacle 14 and permits the receptacle to be more easily shifted into and out of the space defined by the stand 28. A mid-level member 60 is welded to the legs 34 and 36 and provides a stop for the receptacle 14. Guide members 62 and 64 are welded to the mid-level member 60 and to the legs 30 and 32 respectively and serve to provide both structural rigidity and positioning of the receptacle 14. A front bracket 66 is suitably secured to the sink 12 and is provided with a hole that aligns with a hole in member 42 to receive a readily removable pin 68. A bracket 70 is suitably secured to the back wall of the sink 12 and includes an end portion 71 bent inwardly about the rear angle member 44. With the pin 68 in place the sink is effectively secured to the frame 28. When the pin is removed the sink can be lifted slightly, tilting about the member 44, during replacement of the receptacle.

Figure 5:
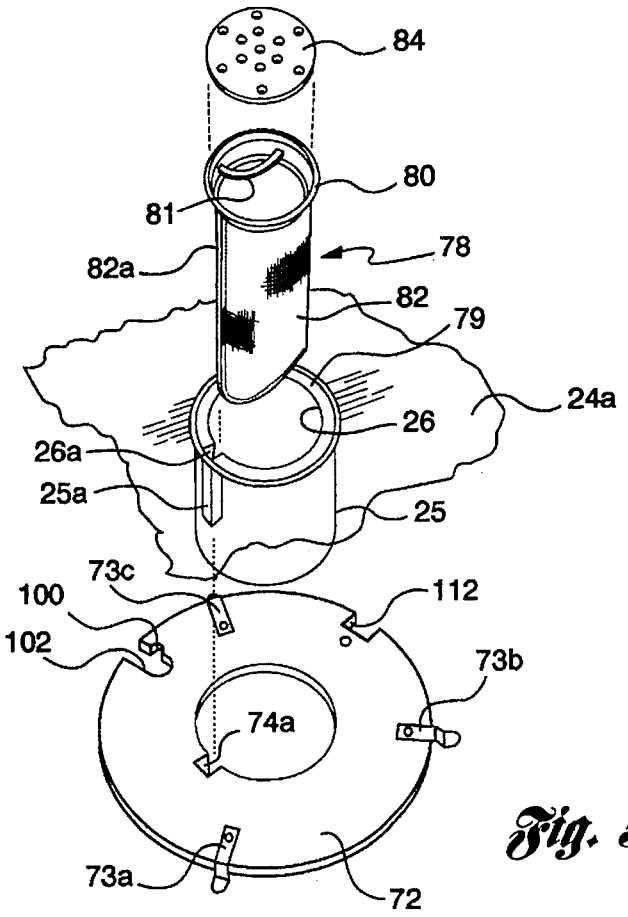
FIG. 5 is an exploded view showing details of the splash guard, filter, and receptacle cover.

With reference to FIG. 5, a suitably sized polyethylene disc 72 covers the receptacle opening and is attached to the neck of the receptacle by three suitably placed spring fasteners **73*a*, 73*b*, and 73*c*. The disc 72 has a central opening 74 that receives the splash guard 25. A key 25*a* is formed on the splash guard 25 and fits in a slot 74*a* formed in the disc, when the receptacle is in place beneath the sink 12 to assist in correctly positioning the receptacle. While the splash guard 25** is in place, heat loss from the solution in the receptacle is minimized, as is splatter from fluid returning to the receptacle from the sink.

A sock strainer generally designated 78, seats in the drain opening 26 in the sink and extends through the splash guard and into the receptacle 14. The strainer 78 serves as a filter by collecting relatively large particles that are removed from the parts during the cleaning process. The strainer 78 includes an annular rim portion 80 formed of a suitable plastic material which rests on an annular support ridge 79 formed in the drain in the bottom of the sink 12. The rim portion 80 includes an integrally formed handle 81 to permit easy removal of the strainer from the sink. A mesh portion 82 of the strainer is joined to the rim portion 80. The ends of the mesh portion of the sock strainer 78 are fastened together as by sewing and form a relatively rigid vertical portion 82*a*. The portion 82*a* is aligned with the indentation 26*a* formed in the drain opening 26 by the integral key 25*a*. With the sink in place, the sock strainer 78 is inserted through the opening in the portion 25. A metal strainer 84 covers the opening in the sock strainer to trap larger sized particles before reaching the sock strainer mesh area 82.

Figure 6:
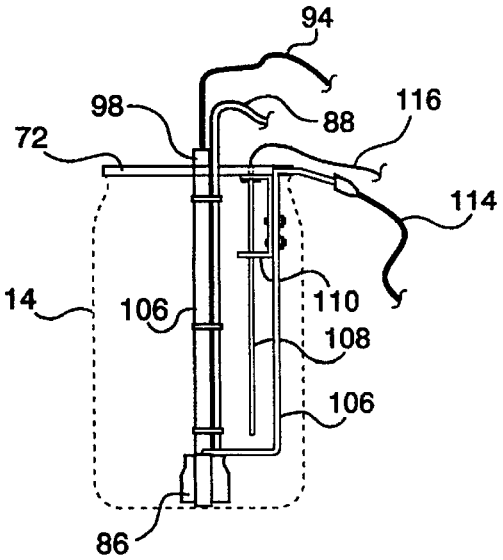
FIGS. 6 and 7 show the fluid receptacle in outline showing the removable pump and heater assemblies.
Figure 7:
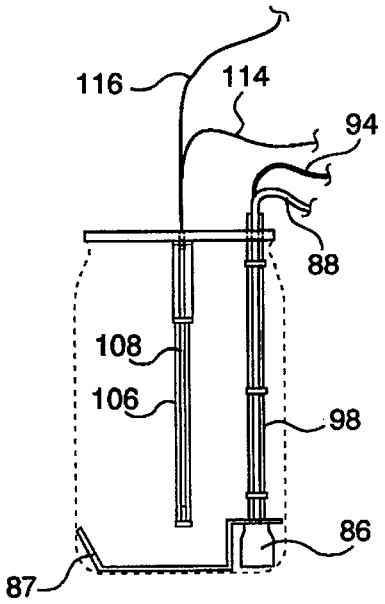

With reference to FIGS. 6 and 7, a system for circulating fluid from the receptacle 14 to the sink 12, includes a submersible pump and electric motor unit 86 enclosed in a plastic housing and suitably situated in the cleaning solution by a bracket 87. The pump 86 is connected with a flexible outlet tube 88 that is removably attached to a splitter 91, mounted in an integrally formed generally rectangular shaped cavity portion 92 of the sink 12, see FIG. 1. The splitter provides fluid output to two flexible tubular portions 93*a* and 93*b*. Preferably, the portions 93*a* and 93*b* include respective manually operated valves for controlling the flow of fluid. The flexible conduit portions 93*a* and 93*b* are respectively coupled to a nozzle and a brush end to deliver solution to the parts located in the sink 12 under hand control of the user. The pump 86 is suitably connected to a power outlet (not shown) through an electrical conductor 94 and a control switch on a switch box generally designated 96 secured to the stand 28. The conductor is protected from the environment by an sealed plastic housing 98. Portions of the disc 72 are cutout as indicated at 100 and 102 to receive the pump outlet tube 88 and housing 98 respectively, see FIG. 5.

A heating element 106 and heat sensor enclosure 108 are fastened to the disc 72 by means of a bracket 110. The element 106 extends through a cutout portion 112 of the disc 72 and over the rim of the receptacle 14. The heating element 106 is electrically connected to the power outlet through conductor(s) 114. The heat sensor (not shown) is housed in the enclosure 108 and is connected by conductor 116 with temperature control circuitry (not shown) mounted in housing 118 secured to the stand 28. The circuitry controls the element 106 to maintain a relatively constant solution temperature elevated sufficiently to improve the cleaning ability of the solution. The bracket 87 maintains a separation between the pump 86 and the heating element 106, avoiding any potential damage to the plastic pump housing.

When servicing is required, the strainer 78 is removed from the sink 14 and the pin 68 is removed. The sink is then tilted sufficiently to permit removal of the receptacle containing the contaminated fluid. The receptacle is moved forward on the conveyor 54 and removed from the space created by the support frame 28. The pump and heater assemblies are removed from the receptacle and placed in a new receptacle with clean fluid. The new receptacle 14 is placed by the user on the conveyor 54, the sink is tilted up and the receptacle is moved rearwardly within the guide members 62 and 64 until the mid-level stop member 60 is reached to thereby position the receptacle in the space vacated by the old receptacle. The sink is then lowered and the key 25*a* mates with the slot 74*a* in the disc 72 as the splash guard 25 is received by the central opening 74 in the disc. The pin 68 is then replaced. Although a full receptacle weighs approximately one hundred and thirty pounds, it is a relatively easy task for the parts washer user to place the receptacle on the conveyor 54 and thereafter with one hand move the receptacle to its final location beneath the sink drain while tilting the sink upwardly with the other hand to move the integral splash guard out of the way.

It will be understood that the above description of the preferred embodiment is by way of example only and that various modifications are possible without departing from the spirit and the scope of the present invention as hereinafter claimed.

What is claimed is:

1. A readily serviceable parts washer comprising, in combination, a sink for receiving parts to be washed, said sink including a bottom wall having an integrally formed cylindrical portion extending centrally from said bottom wall and defining a drain opening and a splash guard, a support structure for said sink, said support structure defining a space beneath said bottom wall for accommodating a cleaning solution storage receptacle, a fluid circulating system including a pump for circulating solution between said receptacle and said sink, a conveyor secured to said support structure for transporting the receptacle during removal from and insertion into said space, said receptacle containing cleaning solution during both insertion into and removal from said space, a cover removably secured to said receptacle and having a central opening, said cylindrical portion extending into said central opening in said cover.

2. The parts washer defined in claim 1, wherein said solution is an aqueous solution and said circulating system further includes a heater for heating said solution, said splash guard when in place being in relatively closed proximity with said central opening to minimize excessive loss of heat from said solution.

3. The parts washer defined in claim 2, wherein said circulating system further includes heat sensor means for sensing the temperature of said solution, said heater and said heat sensor means being attached to said cover, a bracket attached to said pump for positioning said pump in said receptacle and preventing contact with said heater.

4. The parts washer defined in claim 1, wherein said sink includes an integral sump portion from which said cylindrical portion extends, said sump portion fitting within an upper opening formed by said support structure, means removably securing said sink to said support whereby said sink may be tilted upwardly to accommodate said receptacle during replacement.

5. The parts washer defined in claim 4, wherein said sink includes front and rear walls and left and right side walls and a bottom wall, said sump portion being formed in said bottom wall, said support structure including front and rear pairs of legs and upper and lower generally rectangular shaped open portions secured to opposite ends of said legs, said upper open portion sized to conform to and receive said sump portion, said conveyor being secured to front and rear members of said lower portion of said structure, a mid-level member secured to said rear pair of legs and providing a stop for the receptacle, a pair of guide members secured to said mid-level member and to said front pair of legs to provide both structural rigidity and positioning of the receptacle beneath said sink, fastener means removably securing said front and rear wall of said sink to said upper portion of said support structure while permitting said sink to be tilted upwardly away from said support structure.

6. The parts washer defined in claim 1, wherein said splash guard includes an integrally formed key, said cover including an slot for receiving said key.

7. The parts washer defined in claim 6, further comprising a filter supported in said drain opening and extending through said splash guard and into said receptacle to filter fluid returning from said sink to said receptacle, said filter including a mesh portion joined to an annular rim portion that rests on an annular support ridge formed in said drain opening.

8. The parts washer defined in claim 7, wherein said rim portion including an integrally formed handle to assist in removing said filter, said drain opening including an indentation formed by said integral key for receiving an edge of said mesh portion for positioning said filter.

9. The parts washer defined in claim 8, wherein said conveyor comprises a plurality of rollers mounted to a conveyor frame that rests on a work surface, said receptacle being a drum having one end portion supported by said conveyor and an opposite end portion including a receptacle opening, additional fastener means removably securing said cover to said opposite end portion.

10. The parts washer of claim 9, wherein said recirculation system includes at least one fluid conduit for directing fluid toward the parts to be washed.

* * * * *